US007914081B1

(12) United States Patent
Smith

(10) Patent No.: US 7,914,081 B1
(45) Date of Patent: Mar. 29, 2011

(54) CONTOURED SLING WHEELCHAIR SEAT

(76) Inventor: Joel N. Smith, Edmonds, WA (US)

( * ) Notice: Subject to any disclaimer, the term of this patent is extended or adjusted under 35 U.S.C. 154(b) by 16 days.

(21) Appl. No.: 12/173,786

(22) Filed: Jul. 15, 2008

Related U.S. Application Data

(63) Continuation of application No. 11/760,633, filed on Jun. 8, 2007, now abandoned.

(60) Provisional application No. 60/812,584, filed on Jun. 8, 2006.

(51) Int. Cl.
*A47C 7/02* (2006.01)

(52) U.S. Cl. ..... 297/452.56; 297/452.21

(58) Field of Classification Search ..... 297/452.56, 297/452.21, 452.26, 452.22, 452.27, 452.55
See application file for complete search history.

(56) References Cited

U.S. PATENT DOCUMENTS

| | | | | |
|---|---|---|---|---|
| 2,821,335 | A * | 1/1958 | White | 294/142 |
| 3,024,068 | A * | 3/1962 | Eames | 297/452.13 |
| 3,844,612 | A * | 10/1974 | Borggren et al. | 297/451.3 |
| 3,987,507 | A * | 10/1976 | Hall | 5/653 |
| 4,252,367 | A * | 2/1981 | Vanderminden | 297/23 |
| 4,318,556 | A * | 3/1982 | Rowland | 297/448.2 |
| 4,558,904 | A * | 12/1985 | Schultz | 297/440.11 |
| 4,643,481 | A * | 2/1987 | Saloff et al. | 297/452.25 |
| 4,726,624 | A | 2/1988 | Jay | |
| 4,753,480 | A * | 6/1988 | Morell | 297/452.27 |
| 4,828,325 | A * | 5/1989 | Brooks | 297/452.28 |
| 4,960,304 | A * | 10/1990 | Frantz | 297/284.6 |
| 5,189,747 | A * | 3/1993 | Mundy et al. | 5/654 |
| 5,282,286 | A | 2/1994 | MacLeish | |
| 5,687,436 | A | 11/1997 | Denton | |
| 5,762,403 | A * | 6/1998 | Robinson | 297/440.11 |
| 5,836,654 | A * | 11/1998 | DeBellis et al. | 297/452.41 |
| 5,839,140 | A | 11/1998 | Wilkerson | |
| 5,857,749 | A | 1/1999 | DeBellis | |
| 5,984,418 | A | 11/1999 | McInturff | |
| 6,241,320 | B1 * | 6/2001 | Chew et al. | 297/452.26 |
| 6,256,819 | B1 * | 7/2001 | Maier et al. | 5/653 |
| 6,264,279 | B1 | 7/2001 | Chow | |
| 6,428,083 | B2 * | 8/2002 | Dettoni et al. | 296/146.7 |
| 6,502,263 | B1 * | 1/2003 | Rowley et al. | 5/654 |
| 6,625,830 | B2 * | 9/2003 | Lampel | 5/653 |
| 6,687,933 | B2 * | 2/2004 | Habboub et al. | 5/654 |
| 6,755,477 | B2 | 6/2004 | Chow | |
| 7,051,389 | B2 * | 5/2006 | Wassilefky | 5/636 |
| 7,225,485 | B2 * | 6/2007 | Binder | 5/644 |
| 2004/0245837 | A1 * | 12/2004 | Clifford | 297/452.26 |
| 2006/0103225 | A1 * | 5/2006 | Kim | 297/452.26 |
| 2006/0163934 | A1 * | 7/2006 | Chen | 297/440.11 |

* cited by examiner

*Primary Examiner* — David Dunn
*Assistant Examiner* — Philip Gabler
(74) *Attorney, Agent, or Firm* — Christensen O'Connor Johnson Kindness PLLC

(57) ABSTRACT

A seating system for wheelchairs and other applications. The seating system incorporates contours in the substantially flexible seat sling to improve the pressure distribution of the seated user.

20 Claims, 3 Drawing Sheets

CONTOURED SLING WHEELCHAIR SEAT

CROSS-REFERENCE TO RELATED APPLICATION

This application is a continuation of U.S. patent application Ser. No. 11/760,633, filed on Jun. 8, 2007, which claims the benefit of Provisional Application No. 60/812,584, filed Jun. 8, 2006, the disclosure of which is hereby expressly incorporated by reference.

BACKGROUND

A standard wheelchair seat consists of a flexible sling material. The material has adequate strength to support the weight of the user. However, the basic sling shape creates dangerous high pressure areas to the user's skin. The prolonged high pressure can cause pressure sores leading to potentially fatal Pressure Ulcers. The typical method to improve the pressure distribution and support of a person in a wheelchair is to add an additional seat cushion system on top of the wheelchair seat sling. There are many different types of cushioning and support systems. They may use air bladders, fluid filled bags, different density foams, contoured foams or a combination of several technologies. Examples of these methods are shown in U.S. Pat. Nos. 5,687,436; 5,282,286; 4,726,624; and 5,839,140.

Another method is shown in U.S. Pat. Nos. 6,755,477 and 6,264,279 in which multiple layers of flexible non-uniform material such as Lycra or Polartec are specified. The non-uniform materials are used in combination with flexible and/or stiffened materials between the layers to give the seat contours to improve the pressure distribution. Another method is shown in U.S. Pat. Nos. 5,857,749 and 5,984,418 in which the flexible material is replaced with a rigid base on which a cushion is attached. All the known methods come at the price of added cost, weight and complexity to the seating system.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A wheelchair seat including three layers of substantially flexible material of uniform stiffness material having sufficient strength to support an occupant. The three layers of substantially flexible material forming a seat region having a top layer, a middle layer and a bottom layer. The seat region adapted to be coupled to frame side rails of a wheelchair. The wheelchair seat further including a plurality of flexible pads disposed between the upper and middle layers.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A contoured sling wheelchair seat constructed in accordance with one embodiment of the present disclosure may be best understood by referring to FIGS. 1-4. The contoured sling wheelchair seat includes a contoured seat fabric 1 which spans across the width of the wheelchair frame 2 and is attached with the use of two seat attachment strips 15. The seat attachment strips 15 are suitably secured to the wheelchair frame 2 side rails with multiple screws 5 which pass through the seat fabric 1 and seat attachment strips 15 and are then screwed into top side of the wheelchair frame 2 side rails.

Figure 1:
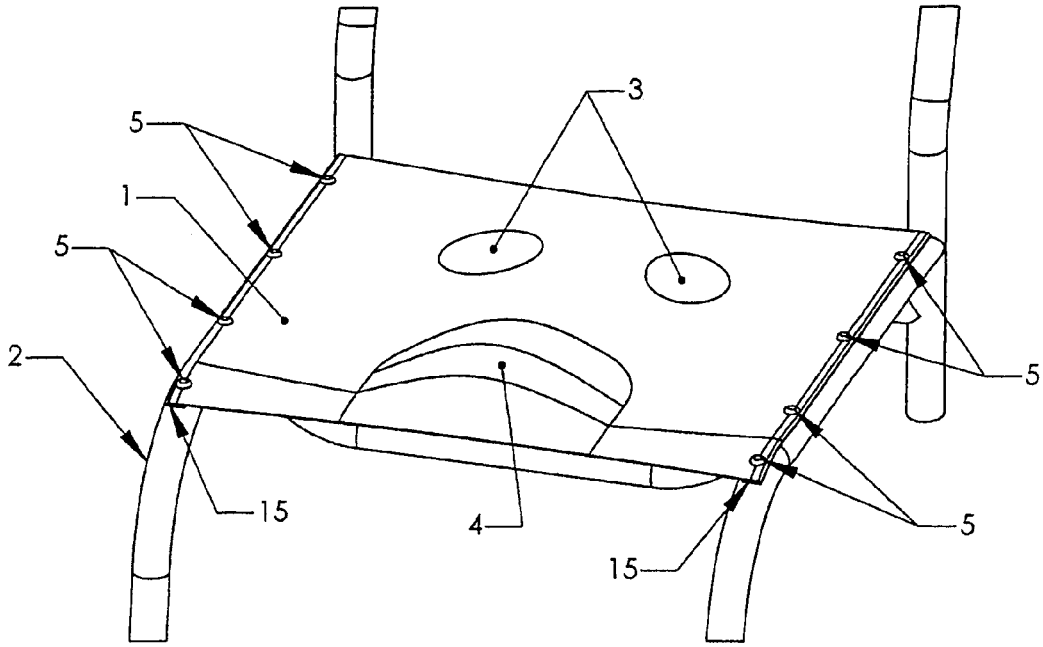
FIG. 1 is an isometric view of the contoured sling seat attached to a wheelchair frame with the wheels and backrest fabric of the wheelchair removed for clarity.
Figure 2:
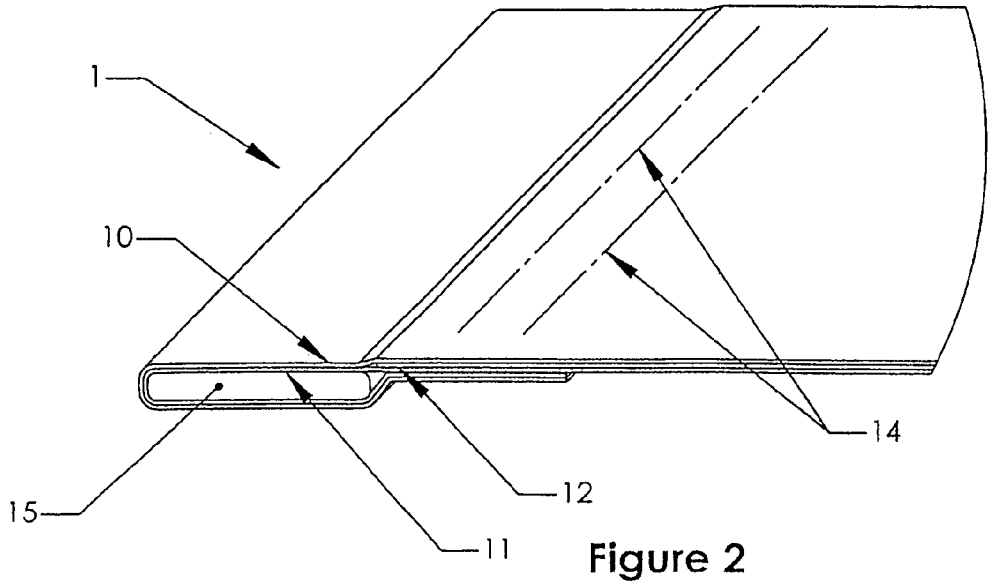
FIG. 2 is a cross-section of the edge of the seat fabric wrapping around the seat attachment strip.

As may be best seen by referring to FIGS. 1 and 2, the contoured seat fabric 1 is constructed of multiple layers of substantially flexible material with adequate strength to support the entire weight of the occupant. The contoured seat fabric 1 includes an upper layer 10, a lower layer 11 and a middle layer 12. The upper, middle and lower layers defining a seat region. At the two outer edges of the contoured seat fabric 1, the outer layer 10 and lower layer 11 wrap around the upper surface of the seat attachment strip 15 and continue around to the underside of the seat attachment strip 15, the two layers continue past the attachment strip 15 an adequate distance to have two rows of stitching 14 pass through them. The middle layer 12 spans across the width of the seat up to the seat attachment strips 15 at either side. The two rows of stitching 14 bind together the upper and lower layers of fabric 10, 11 to envelop the seat attachment strip 15 along with securing the middle layer 12.

Figure 3:
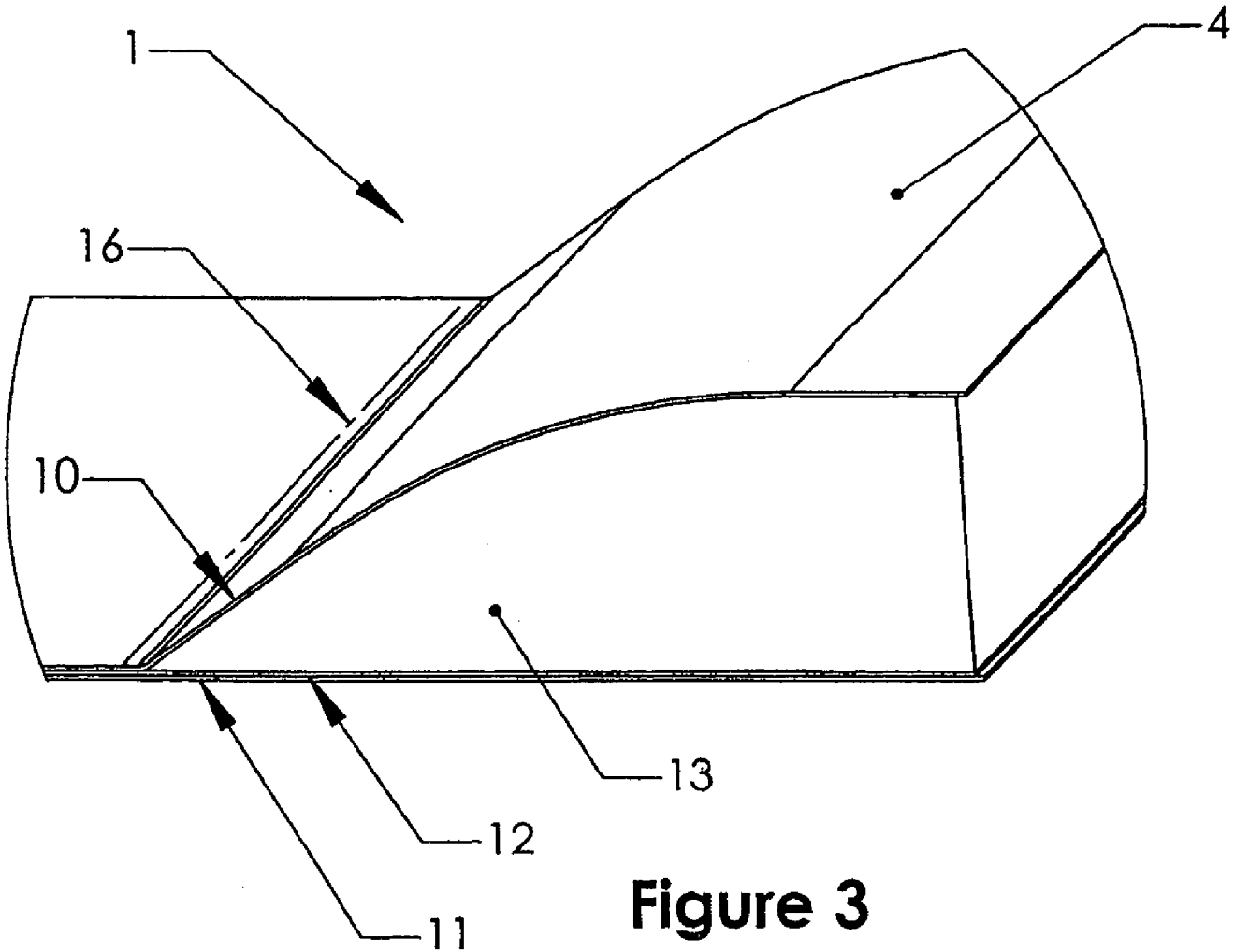
FIG. 3 is a cross-section of the central abductor contour.

As may be best seen by referring to FIGS. 1 and 3, at the forward edge of the contoured seat fabric 1 at its centerline there is a central abductor contour 4. The central abductor contour 4 is accomplished by inserting a section of foam 13 between the upper layer 10 and the middle layer 12. The foam is scalloped at its edges to smoothly transition back to the seat surface. The foam 13 is held in place by a row of stitching 16 which follows around the outer circumference of the foam 13 and binds together the three layers of fabric 10, 11, 12.

Figure 4:
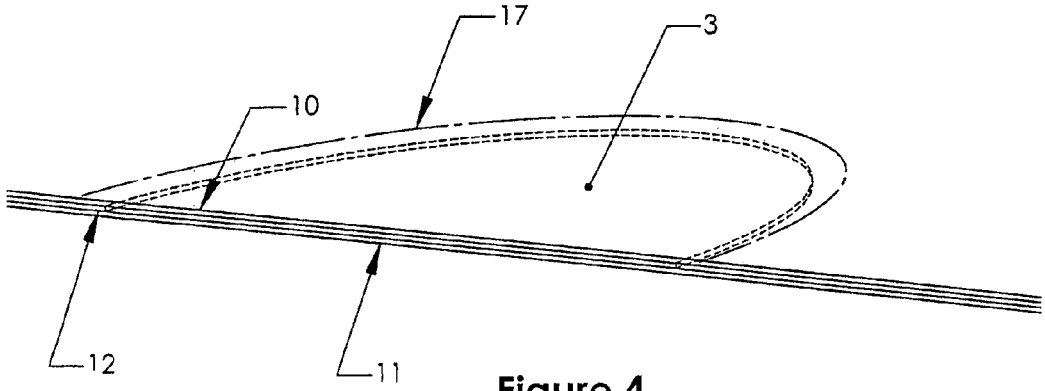
FIG. 4 is a cross-section of a pressure relief pocket.

As may be best seen by referring to FIGS. 1 and 4, in order to reduce pressure under the Ischial Tuberosities there are two pressure relief pockets 3 of reduced stiffness in the seat fabric dimensioned to have areas corresponding to the user's Ischial Tuberosities. The reduced stiffness is accomplished by removing the middle layer of fabric 12 in the area of the pockets 3. The three seating layers 10, 11, 12 are secured to each other around the perimeter of the pockets 3 with a row of stitching 17.

A seating system for wheelchairs and other applications. The seating system incorporates contours in the substantially flexible seat sling to improve the pressure distribution of the seated user. The seat sling having a width dimension between opposite sides sufficient to span across spaced wheelchair seat frame members for support on top of said seat frame members. The seat sling material has adequate material strength to provide a seat base for the sole support of a user while seated thereon when the seat material is mounted to the seat frame members.

The contours in the seat sling are accomplished through a variety of well-known methods. Sewn-in contours can change the shape of the seat to match the shape of the user. The use of strategically placed and shaped filler material within the seat sling can change the shape of the upper surface of the seat. The use of lower stiffness material within the seat sling can lower the pressure in a region of the seat. Transitioning from higher density filler material to lower density filler material can change the pressure in a given area of the seat.

There are several advantages to building the contours into the structural seat sling. Without the need for a secondary seat cushion the cost and the weight of the seating system is reduced. The additional effort to remove the seat cushion every time the wheelchair is folded or transported is eliminated. The potential for breathable mesh materials to be used can improve air circulation and allow moisture to move away from the skin.

While illustrative embodiments have been illustrated and described, it will be appreciated that various changes can be made therein without departing from the spirit and scope of the invention.

The embodiments of the invention in which an exclusive property or privilege is claimed are defined as follows:

1. A wheelchair sling seat, comprising:

(a) top, middle, and bottom layers of substantially flexible material of uniform stiffness, the top, middle, and bottom layers of substantially flexible material forming a seat region, the top, middle, and bottom layers bound together to define first and second outer edges of the seat region that are securable to side rails of a wheelchair frame in a manner that suspends the seat region from the wheelchair frame, wherein the top, middle, and bottom layers have sufficient strength to support an occupant when the first and second outer edges are secured to side rails of a wheelchair frame;

(b) a plurality of flexible pads disposed between the upper and middle layers; and (c) first and second apertures defined only in the middle layer and positioned to correspond to the ischial tuberosities of the occupant, wherein the top layer is engageable with the bottom layer in the areas defined by the first and second apertures.

2. The wheelchair sling seat of claim 1, wherein at least one of the top, middle, and bottom layers are made from a mesh material.

3. The wheelchair sling seat of claim 1, wherein each of the flexible pads are secured in a predetermined position between the upper and middle layers by binding together the top, middle, and bottom layers around the circumference of the flexible pad.

4. The wheelchair sling seat of claim 1, further comprising a flexible pad defining a central abductor contour.

5. The wheelchair sling seat of claim 1, wherein the top, middle, and bottom layers are bound together around the outer circumference of each of the first and second apertures.

6. The wheelchair sling seat of claim 1, wherein at least the upper and lower layers are folded over along the first and second outer edges of the seat region to define first and second folded edge portions securable to the side rails of the wheelchair frame.

7. The wheelchair sling seat of claim 6, further comprising an attachment strip disposed between the upper and lower layers of each folded edge portion.

8. The wheelchair sling seat of claim 1, wherein first and second apertures are defined in at least one of the flexible pads that align the first and second apertures defined in the middle layer.

9. A wheelchair, comprising:

(a) a wheelchair frame having first and second side rails;

(b) a sling seat suspended from the first and second side rails of the wheelchair frame, the sling seat comprising:

(i) top, middle, and bottom layers of substantially flexible material of uniform stiffness, the top, middle, and bottom layers bound together to define first and second outer edges that are securable to the side rails of the wheelchair frame, wherein the top, middle, and bottom layers have sufficient strength to support an occupant when the first and second outer edges are secured to side rails of a wheelchair frame;

(ii) a plurality of flexible pads disposed between the upper and middle layers; and (iii) first and second apertures defined only in the middle layer and positioned to correspond to the ischial tuberosities of an occupant sitting in the seat, wherein the top layer is engageable with the bottom layer in the areas defined by the first and second apertures.

10. The wheelchair of claim 9, wherein at least one of the top, middle, and bottom layers are made from a mesh material.

11. The wheelchair of claim 9, wherein each of the flexible pads are secured in a predetermined position between the upper and middle layers by binding together the top, middle, and bottom layers around the circumference of the flexible pad.

12. The wheelchair of claim 9, wherein the top, middle, and bottom layers are bound together around the outer circumference of each of the first and second apertures.

13. The wheelchair of claim 9, wherein first and second apertures are defined in at least one of the flexible pads that align the first and second apertures defined in the middle layer.

14. A wheelchair sling seat, comprising:

(a) top, middle, and bottom layers of substantially flexible material of uniform stiffness, the top, middle, and bottom layers of substantially flexible material forming a seat region, the top, middle, and bottom layers bound together to define first and second outer edges of the seat region that are securable to side rails of a wheelchair frame in a manner that suspends the seat region from the wheelchair frame, wherein the top, middle, and bottom layers have sufficient strength to support an occupant when the first and second outer edges are secured to side rails of a wheelchair frame;

(b) at least one flexible pad disposed between the upper and middle layers; and (c) first and second apertures defined only in the middle layer and positioned to correspond to the ischial tuberosities of the occupant, wherein the top, middle, and bottom layers are secured together around the perimeter of the first and second apertures with a row of stitching.

15. The wheelchair sling seat of claim 14, wherein the at least one flexible pad is secured in a predetermined position between the upper and middle layers by binding together the top, middle, and bottom layers around the circumference of the at least one flexible pad.

16. The wheelchair sling seat of claim 14, wherein first and second apertures are defined in the at least one flexible pad that align the first and second apertures defined in the middle layer.

17. The wheelchair sling seat of claim 14, wherein the top layer is engageable with the bottom layer in the areas defined by the first and second apertures.

18. The wheelchair sling seat of claim 14, wherein at least one of the top, middle, and bottom layers are made from a mesh material.

19. The wheelchair sling seat of claim 14, wherein at least the upper and lower layers are folded over along the first and second outer edges of the seat region to define first and second folded edge portions securable to the side rails of the wheelchair frame.

20. The wheelchair sling seat of claim 19, further comprising an attachment strip disposed between the upper and lower layers of each folded edge portion.

* * * * *